United States Patent [19]

Aoyama

[11] 4,149,500

[45] Apr. 17, 1979

[54] CONTROL SYSTEM FOR AN EXHAUST GAS RECIRCULATION SYSTEM

[75] Inventor: Syunichi Aoyama, Yokohama, Japan

[73] Assignee: Nissan Motor Company, Limited, Japan

[21] Appl. No.: 818,328

[22] Filed: Jul. 22, 1977

[30] Foreign Application Priority Data

Aug. 5, 1976 [JP] Japan ..... 51/93404

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,888,222 | 6/1975 | Tomita | 123/119 A |
| 4,009,700 | 3/1977 | Engels et al. | 123/119 A |
| 4,040,402 | 8/1977 | Nohira et al. | 123/119 A |
| 4,041,914 | 8/1977 | Sugihara et al. | 123/119 A |
| 4,041,917 | 8/1977 | Suzuki | 123/119 A |
| 4,044,739 | 8/1977 | Miura et al. | 123/119 A |
| 4,056,084 | 11/1977 | Baumgartner | 123/119 A |
| 4,066,056 | 1/1978 | Nohira et al. | 123/119 A |
| 4,069,797 | 1/1978 | Nohira et al. | 123/119 A |
| 4,092,960 | 6/1978 | Nohira et al. | 123/119 A |
| 4,094,287 | 6/1978 | Nohira | 123/119 A |

*Primary Examiner*—Wendell E. Burns

*Attorney, Agent, or Firm*—Robert E. Burns; Emmanuel J. Lobato; Bruce L. Adams

[57] ABSTRACT

Two diaphragms divide a vacuum motor which controls the flow of exhaust gases from the exhaust passage to the induction system into three chambers, the first is fed a modulated vacuum signal from the induction passage, the second either an uncontrolled signal from substantially the aforementioned part of the induction passage or a VC vacuum created immediately upstream of the position assumed by the throttle valve in a fully closed position and the third exposed to atmospheric pressure. A relief valve disposed in the conduit through which the modulated vacuum is fed opens upon the pressure therein falling to a predetermined level to further modulate the vacuum in the first chamber.

The vacuum regulating device which modulates the vacuum from the induction passage is responsive to atmospheric pressure, a signal which originates immediately downstream of a restriction in the EGR passage which may be either greater or less than atmospheric pressure depending on the design of the restriction and a venturi vacuum signal or the equivalent. To modulate the vacuum in the first chamber the relief valve can feed the vacuum which opens it to a normally atmospheric chamber of the vacuum regulating device.

11 Claims, 2 Drawing Figures

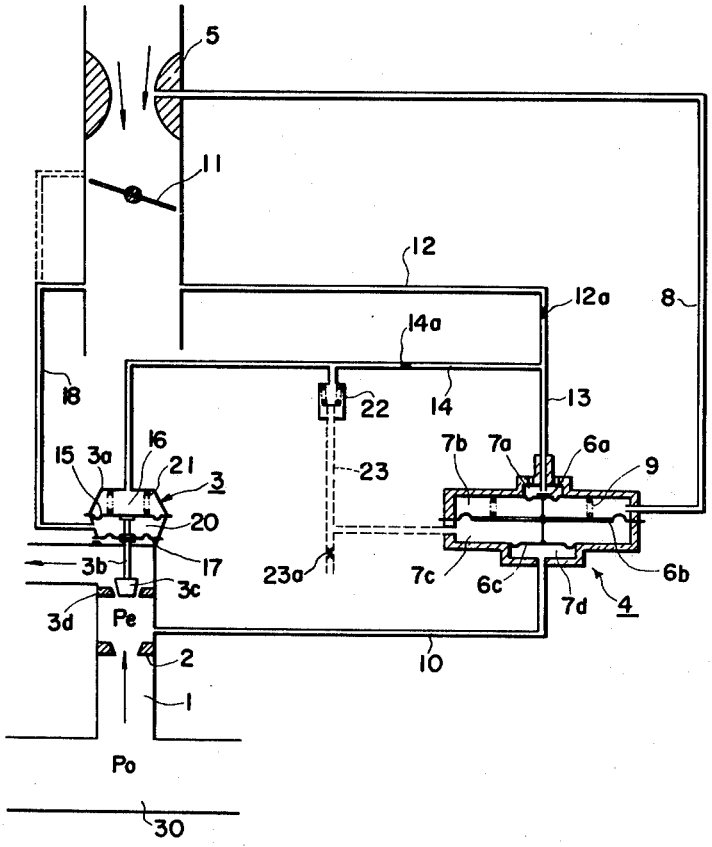

CONTROL SYSTEM FOR AN EXHAUST GAS RECIRCULATION SYSTEM

BACKGROUND OF THE INVENTION

1. Field of the Invention

The present invention relates to an exhaust gas recirculation system and more particularly to a control system for same.

2. Description of the Prior Art

As is well known exhaust gas recirculation (EGR) suppresses the formation of NOx (i.e. the various oxides of nitrogen formed during high temperature pressure combustion) within the combustion chambers of internal combustion engines due to reduction of the combustion rate and according reduction of peak combustion temperatures. As is also well known the amount of EGR must be carefully proportioned with respect to the volume of air inducted into the engine so as to form an air/EGR gas/fuel mixture which exhibits the desired rate of combustion and reduction of peak combustion temperatures. In order to control the amount of EGR gas recirculated and thus form the appropriate air/EGR gas fuel mixture during all modes of engine operation various control systems have beem proposed. Many of these systems use the induction manifold vacuum as a source of motive power and feed same to a vacuum motor operatively connected to a valve which controls the actual flow of exhaust gases from the exhaust system to the induction system. To control the operation of the vacuum motor a pressure regulating device sensitive to one or more operating parameters of the engine modulates the degree of vacuum prevailing in the vacuum chamber of the vacuum motor by introducing atmospheric air into the chamber and/or conduiting connected thereto.

However, a drawback has been encountered with such systems in that insufficient vacuum prevails within the induction manifold at high load and low engine speed operation of the engine so that insufficient force is generated by the vacuum motor to open the EGR valve (as it will be referred to hereinafter) and accordingly insufficient exhaust gas recirculation takes place.

To overcome the above described drawback, it has been proposed to reduce the biasing force of the spring housed in the vacuum chamber so that the vacuum available under high load low RPM conditions opens the EGR valve sufficiently and an adequate supply of exhaust gas is recirculated to the induction system of the engine. However, another drawback has been encountered when using a spring of the type described above and that is the maximum vacuum or minimum absolute pressure permitted to prevail in the vacuum chamber must be limited, viz., the range between the absolute pressure which permits the EGR valve to close and that which opens it completely is considerably restricted by the provision of the less powerful spring. Furthermore this restricted range necessitates very careful control of the modulation of the vacuum to prevent the EGR valve snapping from an open position to a closed position or vice versa. In practice however the vacuum motor equipped with the aforementioned less powerful spring is overly sensitive to small variations in the vacuum fed thereinto from the induction system and the afore described digital or on/off action wherein the valve snaps from one extreme position to another in fact often occurs during normal operation of the vehicle in which the engine is disposed. This on/off action naturally causes erratic engine operation, the supply of exhaust gases being suddenly permitted or cut off, whereby engine performance and emission control deteriorate markedly.

Furthermore the erratic engine operation can under certain conditions be such that the drive is unwantedly distracted by the jolting and surging of the vehicle to a point where he or she is unable to safely control same.

Thus there still remains a need for an EGR control system which recirculates adequate amounts of exhaust gas during high load low RPM operations, eliminates the on/off action of the prior art replacing same with smooth and continuous movement between open and closed positions, while still providing adequate control of the amount of exhaust gas recirculating during other modes of engine operation. This of course includes reducing the rate of exhaust gas recirculating at high speed low load operation during which the production of NOx is inherently low and the normal rate of recirculation provides an excessive amount of exhaust gas.

SUMMARY OF THE INVENTION

Thus in view of the above an EGR control valve system has been developed in which the afore mentioned relatively weak spring is employed but which uses two vacuum signals which counterbalance each other so that only the pressure difference between said signals acts against the spring. Hence the possible variation of the magnitudes of the two signals may be greater than in the prior art to eliminate any on/off type operation. Further since any fluctuation in the vacuum prevailing in the induction system occurs simultaneously in both the counterbalancing vacuum signals the effect of the fluctuations are negated thus assuring smooth trouble free operation.

In detail the vacuum motor which operates the EGR valve is equipped with two diaphragms which are integrally interconnected at their centers, the chamber defined between the two diaphragms being exposed to an uncontrolled source of vacuum, which is either the induction manifold vacuum (existing downstream of the throttle valve) or the so-called VC vacuum (existing in the throttle bore of the induction system just upstream of the location assumed by the throttle valve when it takes a fully closed position). The upper chamber (i.e., the chamber most remote from the EGR valve) is connected to induction system at a location downstream of the throttle valve and a vacuum regulating unit which functions to introduce atmospheric air into the conduiting interconnecting the induction manifold and the aforementioned upper chamber. The lower chamber is arranged to be in constant communication with the atmosphere. The vacuum regulating unit is arranged to have three diaphragms which divide same into four chambers. One of these chambers is fed with either a venturi vacuum or a pressure signal originating just downstream of a restriction disposed in the exhaust passage downstream of the branching of the exhaust passage and the EGR passage. The other chambers are selectively fed one of; a pressure signal originating just downstream of a restriction disposed in the EGR passage, atmospheric air or a partially bled off vacuum prevailing in the vacuum (upper) chamber when said vacuum exceeds a predetermined level.

Thus it is an object of the present invention to provide an exhaust gas recirculation control system which operates smoothly without any on/off characteristics throughout all operational modes of operation of the engine to which it is operatively connected.

It is another object of the present invention to provide an exhaust gas recirculation control system which provides adequate recirculation of exhaust gases during low speed high load operation of the engine to which it is operatively connected.

It is yet another object of the present invention to provide an exhaust gas recirculation control system which reduces the amount of exhaust gases recirculated to the engine during high speed low load operation to accordingly reduce the fuel consumption during this mode of operation but maintain the same NOx suppressing effect.

A further object of the present invention is to provide an exhaust gas recirculation control system which cuts all recirculation of exhaust gases during the initial stages of sudden deceleration and then smoothly re-establishes same.

A still further object of the present invention is to provide an exhaust gas recirculation conrol system which smoothly and continuously varies the amount of exhaust gases fed to the engine with change of engine operating mode.

BRIEF DESCRIPTION OF THE DRAWINGS

Other features, advantages and objects of the present invention will become more clearly understood as the description proceeds taken in conjunction with accompanying drawings in which.

DETAILED DESCRIPTION OF THE PREFERRED EMBODIMENTS

Figure 1:
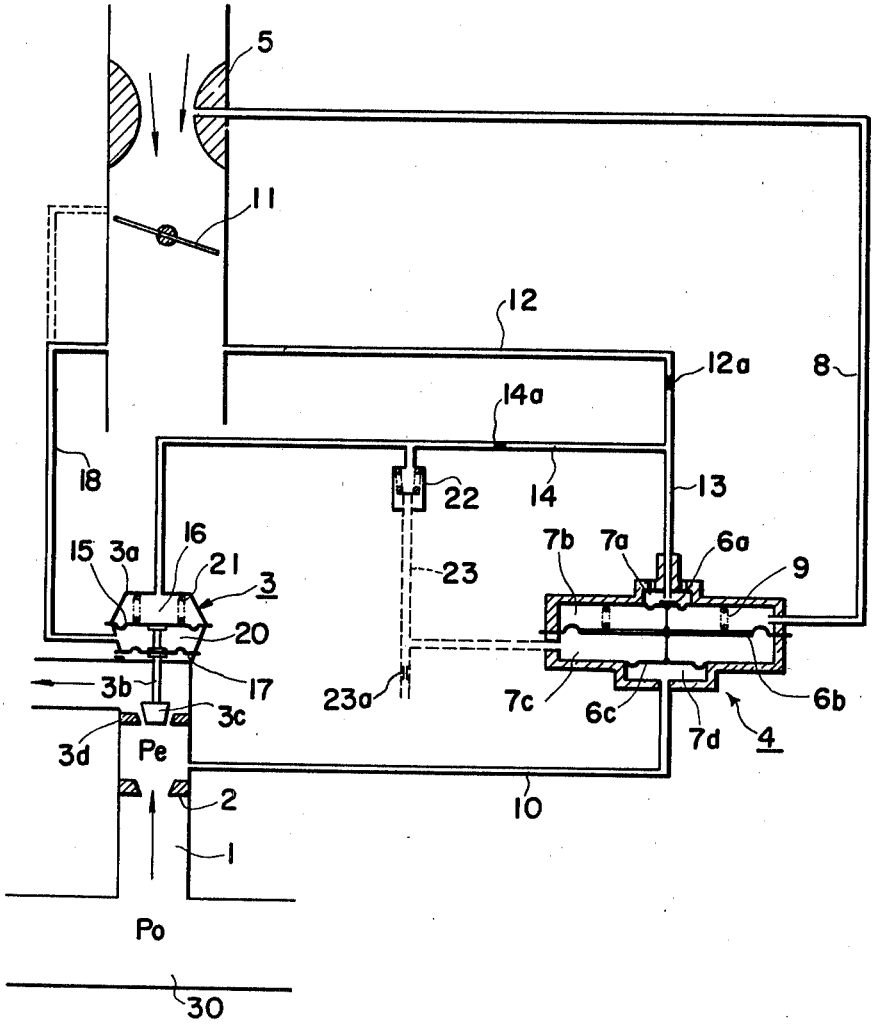
FIG. 1 shows schematically a first preferred embodiment of an EGR control system to the present invention.

In the first preferred embodiment shown in FIG. 1, the numeral 1 denotes an EGR passage in which a restriction 2 is disposed. Generally denoted by the numeral 3 is an EGR control valve. This valve consists of a vacuum motor 3*a*, a valve stem 3*b*, a valve head 3*c* and a valve seat 3*d*. Operatively disposed within the vacuum motor 3*a* are two diaphragms 15 and 17 which are fixedly connected at their centres to the valve stem 3*b* or a rod member connected thereto. The diaphragms are thus interconnected for simultaneous integral movement. The lower diaphragm 17 (as seen in the figure) is as shown arranged to have smaller effective working area than the upper diaphragm 15. Disposed between the upper diaphragm and the casing of the vacuum motor 3*a* is a spring 21 arranged to bias the diaphragms toward the atmospheric chamber (no numeral), i.e., the lowermost chamber of the vacuum motor as seen in the drawings, and thus bias the valve head 3*c* into contact with the valve seat 3*d*.

Now generally denoted by the numeral 4 is a vacuum regulating unit. This unit is divided into four chambers 7*a*, 7*b*, 7*c* and 7*d* by three interconnected diaphragms 6*a*, 6*b* and 6*c*. As seen the effective working areas of the three diaphragms are quite different. The first 6*a* and the second 6*b* having respectively the smallest and the largest effective working areas. A spring 9 is disposed between the casing of the pressure regulating unit 4 and the second diaphragm 6*b* to bias all three diaphragms, via interconnecting rods (no numerals) interconnecting same, toward the fourth chamber 7*d*. Disposed through the casing of the unit is a conduit 13 which as shown projects into the chamber 7*a* so as to juxtapose a flat member fixed to the upper surface of the diaphragm 7*a*. Also formed through the casing so as to permit the first chamber 7*a* to communicate with the atmosphere are a plurality of air holes or ports. Under the influence of the spring 9 the first diaphragm is urged to a position where atmospheric air is permitted to pass through the air holes and into the conduit 13, however this communication is limited and finally cut by the flexing of said diaphragm against the biasing force of the spring 9. Details of this operation will be given in connection with the description of the operation of this embodiment later in the disclosure.

A first conduit 12 is connected to the induction system of the internal combustion engine (not shown) at a location downstream of the throttle valve 11 rotatably disposed in the throttle bore of the induction system. As shown this conduit is interconnected with two other conduits 13 and 14 and has a restriction 12*a* disposed therein. The conduit 13 as previously described communicates with the first chamber 7*a* of the vacuum regulating unit 4. The conduit 14 is shown connected with the upper or control vacuum chamber 16 as it will be referred to hereafter. Accordingly the vacuum introduced from the induction system into the conduit 12 will be referred to hereafter as the control vacuum. Disposed in the conduit 14 between the control vacuum chamber and the junction thereof with the conduits 12 and 13 is a restriction 14*a*; and disposed in the conduit 14 between the restriction 14*a* and the control vacuum chamber is a relief valve 22. This valve is arranged to open upon the vacuum prevailing in the conduit 14 (and therefore the control vacuum chamber) exceeding a predetermined level (or the absolute pressure falling below a predetermined level). It is possible according to the present invention to connect the aforementioned relief valve to (as shown in broken lines) the third chamber 7*c* of the vacuum regulating unit 4 via a conduit 23. As shown a restriction 23*a* is disposed in the conduit so that the third chamber 7*c* is communicated with the atmosphere whereby atmospheric pressure prevails therein when said relief valve 22 is closed but is exposed to a vacuum substantially equal to that prevailing in the conduit 14 and control vacuum chamber 16 when it opens.

The chamber 20 defined between the two diaphragms 15 and 17 or induction vacuum chamber as it will be referred to hereafter is connected through a conduit 18 to either the throttle bore as shown in broken lines immediately upstream of the position taken by the throttle valve when it assumes a fully closed position, or a location downstream of the throttle valve as shown in solid lines. In the first case the vacuum introduced into the conduit 18 will be referred to as "VC" vacuum and in the second case the induction vacuum.

Once again referring to the vacuum regulating unit 4, it will be noted that the second chamber 7*b* thereof is connected through a conduit 8 to the venturi 5 of the induction system and thus exposable to the variable vacuum developed therein. The fourth chamber 7*d* of the unit 4 is as shown connected through a conduit 10 to a chamber defined between the valve seat 3*d* and the restriction 2. It will be noted that the pressure in this chamber which is denoted by Pe can be either, greater or less than atmospheric pressure by varying the diameter of the orifice in the restriction 2. In the case the orifice is arranged to be relatively small with respect to the diameter of the EGR passage, then the passage resistance created by the restriction will, during the period exhaust gases are flowing through the EGR passage, cause the pressure difference on either side of the restriction to be so great that Pe will in fact be below atmospheric. However if the orifice is relatively large (with respect to the diameter of the EGR passage) then the resulting passage resistance will be small and the pressure difference across the restriction will be insufficient to reduce the pressure Pe below atmospheric although there will of course still be a definite pressure difference. The pressure Pe will of course very closely approach and or equal the pressure in the exhaust conduit when the EGR valve is closed and all exhaust gas recirculation is cut. In the present embodiment however it is preferred that the pressure Pe does in fact normally have an absolute value lower than that corresponding to atmospheric pressure.

Let us now consider the operation of the aforedescribed first preferred embodiment mode by mode starting with starting of the engine. During starting of the engine, it is desirable to limit or cut the amount of exhaust gases recirculated. With this embodiment, this is achieved as follows; during cranking of the engine almost no vacuum pevails within the induction system and the throttle valve is invariably closed. Simultaneously the velocity of exhaust gas flowing through the exhaust passage will be negligible since the engine RPM is extremely low. Hence substantially atmospheric pressure will prevail within the chambers 16, 20, **7*b*, 7*c* and 7*d*, thus the springs will urge the two sets of interconnected diaphragms downwardly as seen in the drawings so that the valve head 3*c* will be urged into contact with the valve seat 3*d*. Now upon ignition of the engine, i.e. low load low RPM mode of operation of the engine (with the throttle valve closed) either moderate vacuum or atmospheric pessure will prevail within the induction vacuum chamber 20 depending on whether the conduit 18 is connected so as to deliver induction vacuum or VC vacuum. The pressure Pe will at this stage be approximately atmospheric or slightly higher so as to either not effect the third diaphragm 6*c* or slightly urge same upwardly thus reducing the communication between the air holes and the conduit 13. Thus substantially atmospheric pressure will prevail in the control vacuum chamber 16 whereby the spring 21 will maintain the valve head 3*c* in contact with the valve seat 3*d*. If the conduit 18 is connected downstream of the throttle valve and exposed to the so-called induction vacuum then the diaphragm 15 will be urged toward the chamber 20 by the higher pressure prevailing in the control vacuum chamber 16 thus assisting the spring 20** to maintain the EGR passage closed.

Thus during very low RPM conditions, no exhaust gas recirculation will take place thereby assuring stable engine running during this particular mode of operation.

As the vehicle driver depresses the accelerator and opens the throttle valve the vacuum prevailing in the induction system will drop due to engine turning over at the same RPM but with less restriction to the passage of air thereinto. The EGR valve will remain closed at this time to cut the circulation of exhaust gases since virtually the same pressure conditions continue to prevail within the vacuum motor **3*a* and the vacuum regulating unit. However from this point, the RPM of the engine will increase inducting an increasing amount of air through the venturi portion of the induction system. Hence an increasing venturi vacuum signal will be fed to the second chamber 7*b* of the vacuum regulating unit 4. At this time it is assumed that the valve head 3*c* is still seated on th valve seat 3*d* and the pressure Pe has a positive value (i.e., the absolute value of the pressure Pe is greater than atmospheric). Now since the effective working area of the diaphragm 6*b* is the largest of the three, the venturi vacuum signal will have the greatest effect in the vacuum regulating unit 4 and will cause the diaphragms therein to flex upwardly as seen in the drawings due to the atmospheric pressure in chamber 7*c* acting on said diaphragm and, at this time, slightly higher than atmospheric pressure in chamber 7*d* acting on the diaphragm 6*c*. Due to this upward flexing of the interconnected diaphragms, the first diaphragm 6*a* will approach the open end of the conduit 13 thus reducing the amount of air permitted to enter same. This in turn reduces the amount of the control vacuum which is diluted or bled off and results in the vacuum prevailing in the control vacuum chamber 16 increasing. The pressure differential across the diaphragm 15** is decreased accordingly.

Since the effective working area of the diaphragm 15 is greater than 17, the pressure differential across the diaphragm 15 has a greater effect than that across the diaphragm 17 and since previously substantially atmospheric pressure prevailed in the chamber 16 as compared with a moderate vacuum in 20 the biasing effect of the atmosphere on the atmospheric surface of the diaphragm 17 is neutralized. However at this time, a vacuum is rapidly developing in the chamber 16 permitting the biasing effect of the atmosphere to lift the valve head from the valve seat. This permits the flow of exhaust gases from the exhaust passage to the induction system and simultaneously causes the pressure to change from a positive pressure to a negative pressure,-viz., the absolute value of Pe falls below atmospheric. This phenomenon is caused by the provision of the restriction 2 which increases the velocity of the gases passing between it and the valve seat inducing low pressure conditions therebetween. This change of the pessure Pe is transmitted to the fourth chamber **7*d* of the vacuum regulating unit 4 to modify the position of the diaphragms therein to slightly lower same and permit a slightly greater amount of air to pass into the conduit 13. This of course induces a feedback control phenomenon wherein a slight reduction of the vacuum prevailing in the control vacuum chamber occurs and the EGR valve is slightly closed to reduce the flow of exhaust gases to exactly the desired amount with respect to venturi vacuum (which is a function of the amount of air inducted). Hence from the operation thus far described it will be appeciated that during cranking and initial starting of the engine the spring 21 will overcome the biasing effect of the atmosphere on the diaphragm 17 and possibly be assisted by vacuum fed to the induction vacuum chamber 20 (depending on the place of connection of the conduit 18) to securely prevent exhaust gases being recirculated. Then as the degree of vacuum in the chamber 16** smoothly increases via the aforementioned feedback, the biasing effect of the atmosphere will gradually and smoothly open the EGR valve in proportion to the venturi vacuum signal. Thus any tendency to function on an on/off manner is eliminated.

Now as the RPM or engine speed increases the venturi vacuum will increase proportionally and the amount of air permitted to enter the conduit 13 will gradually diminish to zero. Thus a vacuum equal to that prevailing in the induction vacuum chamber 20 will tend to develop in the control vacuum chamber 16 and the EGR valve will gradually increase its degree of opening. However as previously mentioned, it is not necessary to maintain the same rate of EGR recirculation at high RPM (i.e. low load conditions) thus the relief valve 22 is arranged to open upon the degree of vacuum in the conduit 14 reaching a certain level. This level is of course selected to correspond to the aforementioned low load high RPM conditions. On opening of the check valve 22 atmospheric air is permitted to enter the conduit and consequently the vacuum in the control vacuum chamber falls allowing the EGR valve to close slightly. The rate of EGR is thus decreased below the rate employed during medium load and engine speed whereupon the fuel consumption of the engine is decreased compared with the situation where the normal rate recirculation is maintained. Further as the engine speed increases above the level at which the check valve opens the vacuum prevailing in the control vacuum chamber 16 is constantly reduced by the introduction of atmospheric air thereinto and thus will remain relatively constant while the vacuum in the induction vacuum chamber 20 steadily increases with increase in RPM so that EGR valve is smoothly urged toward its closed position. It is of course possible that a pressure difference of a magnitude which is sufficient to completely close the said EGR valve will be developed during this particuler mode of operation.

It is also possible according to the present invention to provide the aforementioned conduit 23. As shown in broken lines this conduit interconnects the relief valve and the third chamber **7*c* of the vacuum regulating unit 4 so that upon opening of the check valve 22 the normally atmospheric chamber 7*c* has a vacuum fed therein. The degree of the vacuum in fact prevailing in the chamber 7*c* is slightly lower than that which opens the check valve due to the introduction of a small amount of air through the restriction 23*a*. Under such conditions the pressure differential across the diaphagm 6*b* changes and the interconnected diaphragms are permitted to move downwardly since the upward biasing force of the atmosphere acting on the lower side of the diaphragm 6*b* has disappeared. This permits an increased amount of air to enter the conduit 13** resulting in an increased closing of the EGR valve. An even greater reduction of the rate of exhaust gas recirculation thus results.

Figure 2:
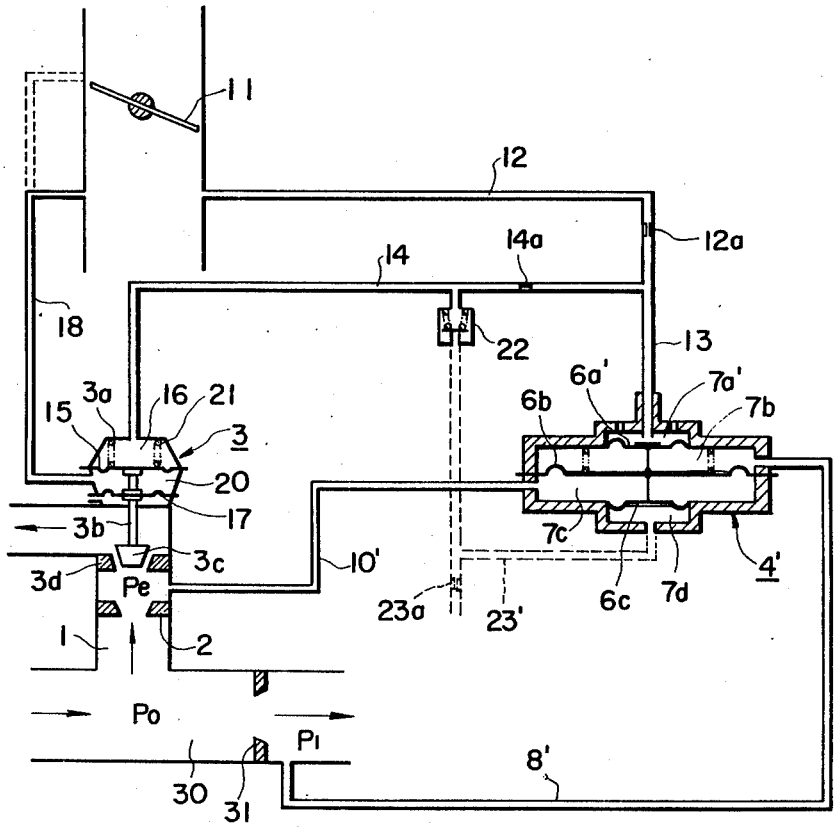
FIG. 2 shows schematically a second preferred embodiment of an EGR control system according to the present invention.

Let us now turn of FIG. 2 wherein a second embodiment of the present invention is shown. The construction and arrangement of this embodiment is very similar to that of the first, so a detailed description of the construction and operation will be omitted save that relevant to components and operation which are different from the former.

As seen the construction and arrangement of the vacuum regulating unit 4' is somewhat different to that of the first embodiment. In this embodiment the first diaphragm **6*a*' is substantially the same diameter as the third 6*c* and thus has approximately the same effective working area. The second chamber 7*b* is connected via conduit 8' to the exhaust passage 30 at a location immediately downstream of a second restriction 31. The pressure $P_1$ prevailing at this location, like Pe, normally has a valve less than $P_o$. The third chamber 7*c* is arranged to receive the pressure Pe through the conduit 10' while the fourth chamber 7*d* is arranged to receive the vacuum from the relief valve 22 via conduit 23'** when open and be a normally atmospheric chamber when said relief valve is closed.

Now before describing the actual operative steps of the second embodiment is desirable to briefly explain the relationship of the pressures Pe and $P_1$ with respect to the volume of inducted air and thus the relation to the venturi vacuum, the latter not being used in this embodiment.

It will be appreciated that the flow rate through the two restrictions 2 and 31 are respectively proportional to $(P_o-P_e)$ and $P_o-P_1$) where $P_o$is the pressure prevailing in the exhaust passage upstream of both restrictions 2 and 31. Assuming for the time that there is no addition of secondary air into the exhaust passage upstream of the junction of the EGR passage and the exhaust passage 30 then the amount of gases actually being exhausted must be proportional to the amount of air inducted. Thus since $P_o-P_1$ indicates the actual flow of gases being exhausted then $P_1$ must be indicative of th volume of inducted air. Further since $(P_o-P_e)$ is indicative of the amount of exhaust gases being recirculated for any given pressure $P_o$ then by controlling the rate of recirculation with respect to the pressure difference $(P_e-P_1)$ (viz., the pressure difference existing across the diaphragm **6*b***) the amount of exhaust gases recirculated with respect the amount actually exhausted will remain constant as long as the pressure differences across the other two diaphragms remain constant. Now even if the pressure $P_o$ is increased by factors other than the amount of air inducted then the pressure difference $(P_e-P_1)$ will remain unchanged and the rate of recirculation can be maintained irrespective of the aforementioned factors such as secondary air injection into the exhaust ports of the engine.

Hence in the construction of the second embodiment the two pressures Pe and $P_1$ are introduced into adjacent chambers so that the aforementioned pressure difference $(P_e-P_1)$ is developed in the form of the pressure difference across the second diaphragm **6*b*. Thus in operation when the engine is idling and no exhaust gases are permitted to be recirculated the pressure $P_e$ will be substantially equal to $P_o$ since there are no exhaust gases flowing throuth the restriction and valve seat 3*d* while the pressure $P_1$ will have a value lower than $P_o$ due to the restriction 31. It should be noted at the time that the diameter of the orifice formed in the restriction 2 in this case is arranged to be relatively large so the pressure Pe is normally above atmospheric. Thus the pressure difference across the diaphragm 6*b* will be such that the interconnected diaphragms will be urged upwardly to reduce or close the opening permitting air to enter the conduit 13. The degree of vacuum prevailing in the control vacuum chamber will immediately begin to rise and thus open the EGR valve 3 (i.e. lift the valve head 3*c* from the valve seat 3*d*). Exhaust gas will begin flowing through the restriction and valve seat to cause the pressure Pe to assume a positive value which is lower then $P_o$. The pressure differential across the diaphragm 6*b* will change accordingly and the amount of air permitted to enter the conduit 13** will be increased. The amount of exhaust gases will be reduced via the aforedescribed feedback control to a level appropriate for the amount of air inducted into the engine.

As the engine speed rises and the amount of inducted air rises therewith the absolute value of the pressure $P_1$ will increase proportionally with the increase of pressure $P_o$. The pressure differential across the diaphragm 6b will change moving the interconnected diaphragms upwardly to reduce the amount of air entering the conduit 13. The EGR valve will increase its degree of opening and increase the amount of exhaust gases permitted to pass through the restriction and valve seat 3d thus preventing the value of Pe from increasing. This change of the pressure $P_1$ will cause the pressure difference across the diaphragm to change so that the desired difference ($P_e$–$P_1$) will be obtained. Thus as the engine speed rises and the pressure $P_o$ rises the afore-described feedback control phenomenon will continue to occur so that the rate of EGR will be proportioned with respect to the volume of inducted air until the aforementioned predetermined pressure (vacuum) within the conduit 14 and control vacuum chamber is reached whereupon the relief valve 22 will open and permit the introduction of atmospheric air therethrough to reduce the degree of the vacuum prevailing in the control vacuum chamber 16. As described earlier the amount of exhaust gases recirculated will be decreased during the high engine speed load conditions the predetermined vacuum is indicative of. To further increase the degree of which the exhaust gas recirculation is reduced the conduit 23' shown in broken lines can be employed to conduct the vacuum from the conduit 14 to the normally atmospheric chamber 7d. As will be obvious if the vacuum is conducted to the chamber 7d the interconnected diaphragms will be further moved downwardly to a degree to where an increased amount of air will be permitted to enter the conduit 13 and the amount of exhaust gas recirculation will be reduced accordingly.

Further according to the present invention both embodiments will provide an additional feature in that during the initial stages of sudden deceleration the flow of exhaust gases will be cut and then smoothly reestablished. To intiate sudden deceleration the driver will release the accelerator pedal and possibly press the brake pedal. The release of the accelerator pedal of course causes the throttle valve to close. Thus, in the first embodiment the venturi vacuum signal will disappear causing a sudden change in the pressure differential across the diaphragm 6b to occur. Substantially atmospheric pressure will prevail in the chamber 7b thus causing the interconnected diaphragms to move downwardly permitting an increased amount of atmospheric air to flow into the conduit 13. As described earlier the vacuum in the control vacuum chamber 16 decreases whereupon the pressure differential across the diaphragm 15 will urge it and the valve stem toward the induction vacuum chamber 20 and thus the valve head 3c toward the valve seat 3d. According to the present invention this biasing force generated by the just mentioned pressure differential across the diaphragm 15 is sufficient to close the valve head against the valve seat and stop exhaust gas recirculation. Very shortly after the throttle valve closes and the venturi vacuum disappears the flow of exhaust gases through the exhaust conduit will drop whereby the pressure $P_1$ downstream of the restriction 31 will decrease. This, when coupled with the pressure Pe having assumed a value substantially equal to $P_o$, will urge the interconnected diaphragms in the vacuum regulating unit 4 to move upwardly to reduce the degree of opening of the conduit 13. The vacuum prevailing in the control vacuum chamber 16 will thus rise and permit the EGR valve 3 to open and re-establish exhaust gas recirculation. Subsequently a feedback control will take place to adjust the flow rate to a desirable level. As will be appreciated, the provision of the two restrictions 12a and 14a help to provide smooth operation of the EGR valve 3 not only during the just described mode of operation but throughout all modes of operation.

What is claimed is:

1. An exhaust gas recirculation control system which controls the flow of exhaust gases through an exhaust gas recirculation passage interconnecting the induction system of an internal combustion engine with the exhaust passage of said engine, comprising:

exhaust gas recirculation valve means so constructed and arranged as to be responsive to first and second pressure signals and atmospheric pressure and control the amount of exhaust gases passing through said exhaust gas recirculation passage in accordance with said first and second pressure signals and the atmospheric pressure, said first and second pressure signals being fed to exhaust gas recirculation valve means via first and second conduit means respectively;

vacuum regulating means so constructed and arranged as to be fluidly connected to said exhaust gas recirculation valve means and be responsive to fourth and fifth pressure signals and the atmospheric pressure to modulate the magnitude of said first pressure signal;

pressure relief valve means disposed in said first conduit means and so constructed and arranged as to be responsive to said first pressure signal and to open on upon the magnitude of said first pressure signal falling below a predetermined level thus further modulating said first pressure signal by the introduction of said atmospheric pressure into said first conduit means.

2. A control system as claimed in claim 1 further comprising conduit means so constructed and arranged as to interconnect said pressure relief valve means and said vacuum regulating means so that upon opening of said pressure relief valve means in response to said first pressure signal falling below said predetermined level said first pressure signal is fed through said conduit means to said vacuum regulating means so as to replace said atmospheric pressure therein and thus render said vacuum regulating means responsive to said fourth, fifth and first pressure signals while said first pressure signal is below said predetermined level.

3. A control system as claimed in claim 1 wherein said exhaust gas recirculation valve means comprises:

a vacuum motor having first and second diaphragms disposed therein to define within said vacuum motor first, second and third chambers, said first chamber being fed said first pressure signal via said first conduit means, said second chamber being fed said second pressure signal via said second conduit means and said third chamber being fed atmospheric pressure via an atmospheric air port formed in the casing of said vacuum motor, said first and second diaphragms being interconnected at their centres by rod means so as to be integrally movable a valve stem connected at a first end to said rod means so as to be movable via the flexing of the interconnected first and second diaphragms;

a valve head fixedly connected to the other end of said valve stem;

a valve seat disposed in said exhaust gas recirculation passage, said valve head being arranged to be sealingly seatable in said valve seat; and biasing means disposed in said first chamber which is arranged to bias the interconnected first and second diaphragms and the valve stem connected to the rod means interconnecting said first and second diaphragms in a direction which urges said valve head into sealing engagement with said valve seat.

4. A control system as claimed in claim 3 wherein said vacuum regulating means comprises a casing having third, fourth and fifth diaphragms disposed therein to define within said casing fourth, fifth, sixth and seventh chambers, said third, fourth and fifth diaphragms being interconnected at their centres by rod means so as to be integrally movable said fourth chamber communicating with the atmosphere through holes formed in the portion of the casing defining said fourth chamber and communicating with said conduit means via a first conduit, said first conduit being arranged to project into said fourth chamber so as to juxtapose said third diaphragm, the arrangement of said first conduit and said third diaphragm being such that flexing of said interconnected third, fourth and fifth diaphragms toward said first conduit reduces the amount of air permitted to pass from said through holes into said first conduit, said fifth chamber communicating with the venturi portion of the induction system of said internal combustion engine via a second conduit so as to be exposed to the variable vacuum developable therein, said variable vacuum functioning as said fourth pressure signal said sixth chamber being communicated with the atmosphere via a through hole formed in the portion of said casing which defines said sixth chamber and said seventh chamber communicating with said exhaust gas recirculation passage via a third conduit, said third conduit opening into said exhaust gas recirculation passage between said valve seat and a first restriction disposed upstream of said valve seat the pressure developable within the chamber defined between said valve seat and said restriction functioning as said fifth pressure signal.

5. A control system as claimed in claim 1 wherein said vacuum regulating means comprises:

a casing having third, fourth and fifth diaphragms disposed therein to define within said casing fouth fifth, sixth and seventh chambers, said third, fourth and fifth diaphragms being interconnected at their centres by rod means so as to be integrally movable;

said fourth chamber communicating with the atmosphere through through holes formed in the portion of the casing which defines said fourth chamber and communicating with said first conduit means via a first conduit, said first conduit being arranged to project into said fourth chamber so as to juxtapose said third diaphragm, the arrangement of the said first conduit and said third diaphragm being such that flexing of said interconnected third, fourth and fifth diaphragms toward said first conduit reduces the amount of air permitted to pass from said through holes into said first conduit;

said fifth chamber communicating with the exhaust passage via a fourth conduit, said fourth conduit opening into said exhaust passage immediately downstream of a second restriction, said second restriction being disposed in said exhaust passage downstream of where said exhaust gas recirculation passage opens into said exhaust passage, the pressure developable immediately downstream of said second restriction functioning as said fourth pressure signal;

said fixth chamber being communicated with said exhaust gas recirculation passage via a fifth conduit, said fifth conduit opening into said exhaust gas recirculation passage between said valve seat and a first restriction, the pressure developable within the chamber defined between said valve seat and said second restriction functioning as said fifth pressure signal; and said seventh chamber being communicated with the atmosphere through a through hole formed through the portion of the casing defining said seventh chamber.

6. A control system as claimed in claim 4 wherein said conduit means is connected between said pressure relief means and said through hole formed in the portion of the casing defining said sixth chamber.

7. A control system as claimed in claim 5 wherein said conduit means is connected between said pressure relief means and said through hole formed in the portion of the casing defining said seventh member.

8. A control system as claimed in claim 1 wherein said second conduit means is a conduit which opens into the induction system of the internal combustion engine downstream of a throttle valve operatively disposed therein.

9. A control system as claimed in claim 1 wherein said second conduit means is a conduit which opens into the throttle bore of said induction system of said internal combustion engine immediately upstream of the position which a throttle valve operatively disposed in said induction system assumes in a fully closed position.

10. A control system as claimed in claim 4 wherein said first conduit means comprises a conduit which is so constructed and arranged as to open into said induction system of said internal combustion engine downstream of a throttle valve operatively disposed in said induction system, have third and fourth restrictions disposed therein, said restrictions being arranged on either side of the junction of said first conduit with said first conduit means and have said relief valve means disposed in the conduit between said third and fourth restrictions and said first chamber.

11. A control system as claimed in claim 2 wherein said conduit means comprises a first conduit which is connected at a first end thereof to said pressure relief valve means and has a fifth restriction disposed in the other end thereof, and a second conduit which opens into said first conduit between said pressure relief valve means and said fifth restriction at one end thereof and which is fluidly connected to said vacuum regulating means at the other end thereof.

* * * * *